US006074096A

United States Patent [19]

Tilman

[11] Patent Number: 6,074,096

[45] **Date of Patent: *Jun. 13, 2000**

[54] CLOSURE ARRANGEMENT HAVING IMPROVED THERMAL STABILITY AND METHODS THEREOF

[75] Inventor: Paul A. Tilman, Sherwood, Wis.

[73] Assignee: Reynolds Consumer Products, Inc., Appleton, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 09/017,849

[22] Filed: Feb. 3, 1998

[51] Int. Cl.[7] ..... B65D 33/25

[52] U.S. Cl. ..... 383/63; 24/587

[58] Field of Search ..... 383/63; 24/587

[56] References Cited

U.S. PATENT DOCUMENTS

| | | | |
|---|---|---|---|
| 4,354,101 | 10/1982 | Tilman | 383/63 |
| 4,673,383 | 6/1987 | Bentsen | 383/63 X |
| 4,807,300 | 2/1989 | Ausnit et al. | 383/65 |
| 4,824,497 | 4/1989 | Tilman | 383/63 X |
| 5,242,516 | 9/1993 | Custer et al. . | |
| 5,293,672 | 3/1994 | Tominaga et al. . | |
| 5,628,566 | 5/1997 | Schreiter | 383/63 |
| 5,655,273 | 8/1997 | Tomic et al. | 383/63 X |
| 5,747,126 | 5/1998 | Van Erden et al. | 383/63 X |

FOREIGN PATENT DOCUMENTS

| | | | |
|---|---|---|---|
| 4339768 | 11/1992 | Japan | 383/63 |

*Primary Examiner*—Jes F. Pascua
*Attorney, Agent, or Firm*—Alan M. Biddison

[57] ABSTRACT

A closure arrangement is disclosed having a base strip configured to be thermally-fused to a web of a recloseable package. The base strip contains a compartment having low thermal conduction properties. The compartment protects a zipper profile or profiles from thermal deformation during sealing of the closure arrangement to the web. The compartment contains air or other gases in specific implementations. In addition, the invention is directed to a package containing the closure arrangement, and to methods of making the package and methods of making the closure arrangement.

16 Claims, 4 Drawing Sheets

CLOSURE ARRANGEMENT HAVING IMPROVED THERMAL STABILITY AND METHODS THEREOF

FIELD OF THE INVENTION

The present invention relates to recloseable bags, closure arrangements, and methods for creating the same. More particularly, the invention relates to a zipper having male and female profiles configured to have improved stability during fusion by heat to the walls of a flexible package.

BACKGROUND OF THE INVENTION

Many consumer packaging applications employ bags using recloseable zippers for locking products within the bags. One type of recloseable zipper includes male and female profiles extending along the entire length of the zipper. The male profile is often tree shaped, with an expanded head portion supported by a narrower trunk portion. The female profile is disposed opposite the male profile and is adapted to interlock with the male profile by a pair of legs having locking edges and cornered shoulders. The profiles are interlocked by properly aligning the male and female profiles and pressing them together along the entire length of the zipper. The opposing legs of the female profile slide over the head portion of the male profile, and lock to it by locking the head with the cornered shoulders.

Recloseable zippers are typically formed of a polymeric material by an extrusion process. The zipper is typically attached to a polymeric film used to form the recloseable bag. Each recloseable zipper is normally permanently attached to a polymeric bag or film by a thermal-fusion process in which a heated metal bar is pressed against the zipper while the zipper is in contact with the polymeric bag or film. The attachment is frequently made prior to sealing and cutting of the film's side walls to form the finished bag.

Conventional zippers can be problematic during thermal-fusion because heat sufficient to bond the zipper profiles to the polymeric bag call result in deformation of the male profile, female profile, or both profiles. This thermal deformation can produce a permanent change in the shape of the profiles, and interfere with inter-locking of the profiles. Such interference may result in the profiles not locking, or inadequately locking so that the seal between the profiles permits excess leakage into, or out of, the bag. In addition, in some circumstances, the deformed profile can result in packages that open unexpectedly or open with a lower force than is desirable.

The problems associated with deformation of the zipper profiles are sometimes exasperated in zipper profiles that require more than one type of polymeric material or in closure arrangements having particularly complex profiles or profiles with very low tolerances to deformation. For example, in many applications, the polymeric material forming the recloseable zipper and the polymeric material forming the bag are not the same material. During heat sealing of the zipper to the bag, it is frequently desirable that the temperature of the base portion of the profile in contact with the package film reach a point sufficient to melt, or slightly melt, both the base portion and the package film. However, a polymeric material having a low melting point will sometimes be subject to excessive melting, and this excessive melting can be a problem if the profiles deform during thermal-fusion to the bag. Also, zippers having unusually small elements, or having very close tolerances for forming seals, are also vulnerable to deformation during the thermal-fusion process.

Consequently, a need exists for a zipper profile for a recloseable bag which overcomes the aforementioned shortcomings associated with existing zippers, and which can be thermally-fused to a flexible package with low deformation of the profile members.

SUMMARY OF THE INVENTION

The present invention is directed to a closure arrangement for a recloseable bag or package and methods relating to the same. In specific implementations of the present invention, the closure arrangement includes a polymeric base strip configured to be heat sealed to a web of a recloseable package. The base strip has an inner side and an outer side, a zipper profile member integrally formed to the inner side of the base strip, and an insulating compartment within the base strip between a portion of the inner side and outer side.

The compartment contains a material that conducts heat at a rate lower than the material forming the polymeric base strip, and as such, insulates the profile from the heat generated during thermal-fusion. In specific implementations, the compartment encloses air or another gas. In certain implementations of the invention, the volume defined by the polymeric base strip is positioned only in a base strip containing a female profile, and not in a base strip containing a male profile. In yet other implementations, this compartment includes foamed polyethylene or another polyolefin carrier.

The zipper profile may comprise a female profile including at least two legs, the legs defining a surface configured and arranged to engage arid retain a male profile. In other implementations, the zipper profile comprises a male profile including a head and a stem. The head and stem define a surface configured and arranged to be received and retained by a female profile. The compartment is positioned in the base strip proximate an end of the stem distal from the head of the male profile.

The polymeric base strip includes an attachment portion and a profile portion in certain implementations of the present invention. The attachment portion is configured to be positioned proximate the web of the polymeric bag, and the profile portion includes a male profile configured to engage an opposing female profile. In specific implementations, the attachment portion is constructed of a first polymeric material, and the profile portion is constructed of a second different polymeric material. The attachment portion may further include a heat-setting adhesive. This adhesive may be selected from a variety of differing types. In one application, the adhesive may be selected from the group consisting of anhydride modified polyolefins, metallocene catalyzed low density polyethylene, maleic anhydride, anhydride modified ethylene vinyl acetate, polypropylene copolymers, polypropylene copolymers blended with ethylene vinyl acetate, polypropylene copolymers and polyolefin blends, polypropylene terpolymers, polypropylene terpolymers and polyolefin blends, polypropylene terpolymers and ethylene vinyl acetate blends, polypropylene based thermoplastic polyolefins, butene polypropylene copolymers and polypropylene-based flexible polyolefins.

In one implementation, the closure arrangement is formed by extrusion, wherein the attachment portion and profile portion of the base strip are formed by simultaneous co-extrusion. The compartment within the base strip may also be formed during the extrusion process. Alternatively, the attachment portion and profile portion of the base strip are extruded separately and subsequently joined to each other after extrusion to form the compartment.

Another aspect of the invention is a recloseable package having first and second generally extruded base strips, each of the base strips having an inner side and an outer side. The package includes a first zipper profile positioned on the inner side of the first base strip and a second zipper profile positioned on an inner side of the second base strip. The zipper profiles are positioned and configured to interlock with one another. A compartment is contained within at least one of the first and second extruded base strips. The compartment is positioned within the extruded base strips between the inner side and the outer side. A polymeric film is secured to the outer side of each of the base strips. In specific implementations, the compartment within at least one of the first and second base strips has low heat conduction properties. As noted above, this compartment within at least one of the first and second base strips encloses air in certain implementations.

Another aspect of the invention is directed to a method of manufacturing a closure arrangement for a polymeric bag having first and second opposing base strips. The method includes providing an extrusion die configured and arranged for the extrusion of at least one polymeric material, and providing a thermoplastic material for extruding through the extrusion die. The thermoplastic material is extruded through the extrusion die to form a base strip, the base strip having an inner side, an outer side, a zipper profile integrally formed to the inner side, and a compartment defined by a space between the inner side and outer side of the base strip.

The step of extruding a thermoplastic material may include extruding a first material to form a portion of the base strip proximate the inner side and the female profile, and extruding a second material to form a portion of the base strip proximate the outer side of the base strip.

In a specific implementation, the method further includes providing a polymeric film having an interior surface and an exterior surface, and providing a closure arrangement having first and second base strips, each of said base strips having an inner side, an outer side, a zipper profile integrally formed to the inner side, and a compartment defined by a space between the inner side and outer side of the base strip. The closure arrangement is positioned so that a portion of the outer side of each base strip proximate the compartment is near the polymeric film; and the polymeric film is thermally-fused or heat-set to the base strips by application of heat to the polymeric film and the closure arrangement. The outer side of each base strip is permanently adhered to the interior surface of the polymeric film at a position opposite the compartment.

The above summary of the present invention is not intended to describe each illustrated embodiment of the present invention. The FIGS. and the detailed description which follow should make more aspects of the invention apparent.

BRIEF DESCRIPTION OF THE DRAWINGS

Other aspects and advantages of the invention will become apparent upon reading the following detailed description and upon reference to the drawings in which.

Figure 1:
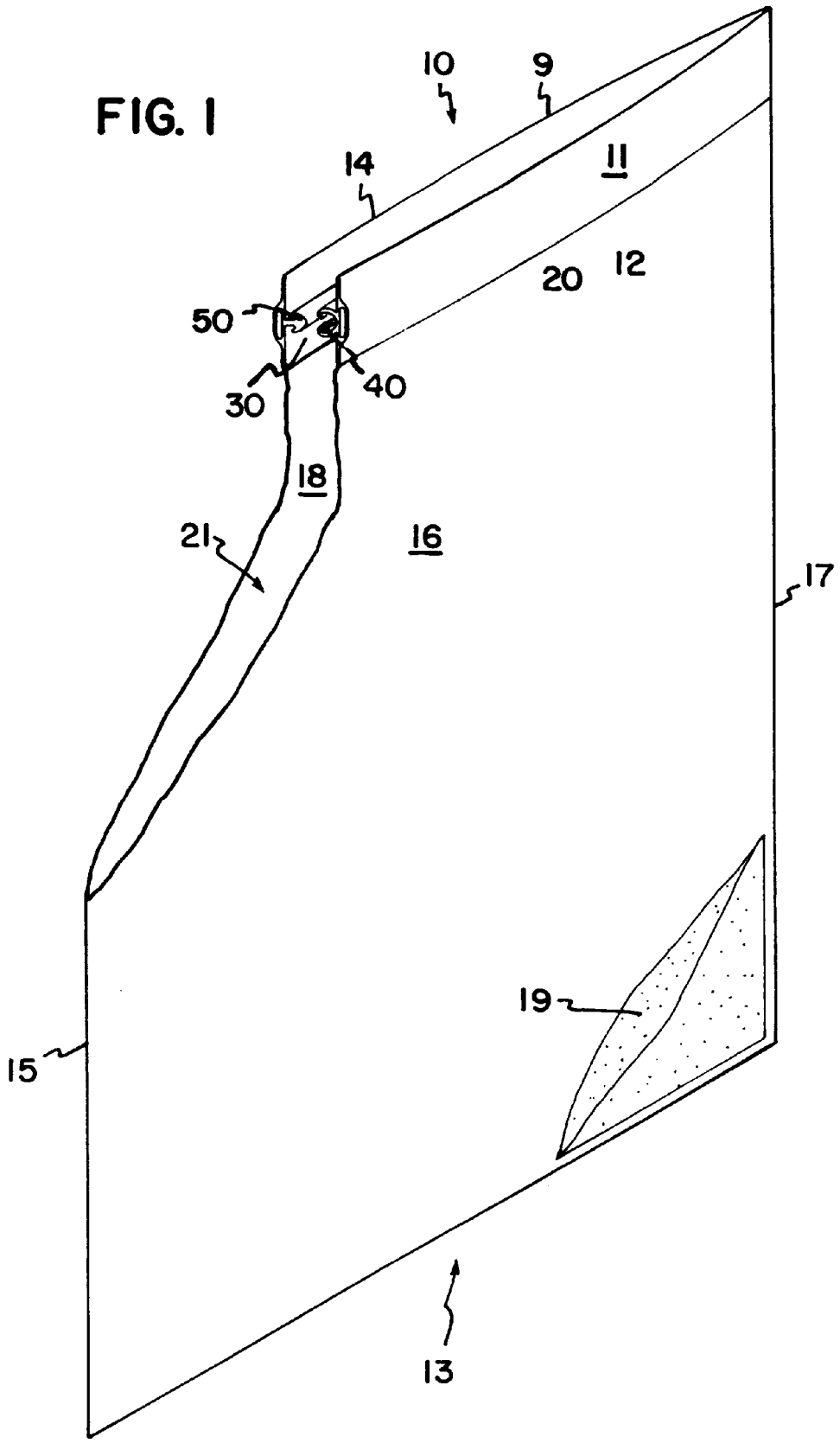
FIG. 1 is a partial perspective view of a recloseable package constructed and arranged in accordance with the present invention.

While the invention is susceptible to various modifications and alternative forms, specifics thereof have been shown by way of example in the drawings and will be described in detail. It should be understood, however, that the intention is not to limit the invention to the particular embodiments described. On the contrary, the intention is to cover modifications, equivalents, and alternatives falling within the spirit and scope of the invention as defined by the appended claims.

DESCRIPTION OF THE ILLUSTRATED EMBODIMENTS

The present invention is generally applicable to closure arrangements for flexible packages. The invention is particularly applicable to polymeric bags requiring thermal-fusion, also known as heat sealing, in order to affix the closure arrangement to a polymeric web forming the walls of the flexible package. One aspect of the present invention is directed to a closure arrangement for a recloseable bag or package having a polymeric base strip, a zipper profile, and a compartment within the base strip. The polymeric base strip is configured to be heat sealed to a web of the recloseable package, and the base strip has an inner side and an outer side. The zipper profile member is integrally formed to the inner side of the base strip. The compartment within the base strip is defined by the polymeric base strip on a first side and a zipper profile member on a second side. During heat sealing of the closure arrangement to the wall of a flexible package, the compartment insulates and protects the zipper profile from the heat required to fuse the base strip to the web. As such, the zipper profile is exposed to lower temperatures and avoids heat damage and deformation.

As shown generally in FIG. 1, a recloseable package 10 that is constructed in accordance with the present invention includes a closure arrangement 9 having a first closure profile 12 and a second closure profile 14. In the embodiment depicted, the closure profiles 12 and 14 are joined to first and second webs 16, 18. The closure profiles 12, 14 include zipper profiles 40 and 50. It will be observed from FIG. 1 that zipper profile 40 is a female profile and zipper profile 50 is a male profile. First and second closure profiles 12 and 14 further include base strips 20, 30.

Flexible package 10 includes a first edge 15 and a second edge 17, along with a bottom edge 13. These edges, along webs 16 and 18, define the interior 21 of the flexible package 10. In the embodiment depicted, contents 19 are shown in the bottom of interior 21 of the package 10. The closure profiles 12, 14 combine to form the closure arrangement 9, which is positioned proximate the top 11 of the package 10. It will be noted that contents 19 may be any of numerous materials known in the art, including such things as food, manufacturing parts and hardware.

Figure 3:
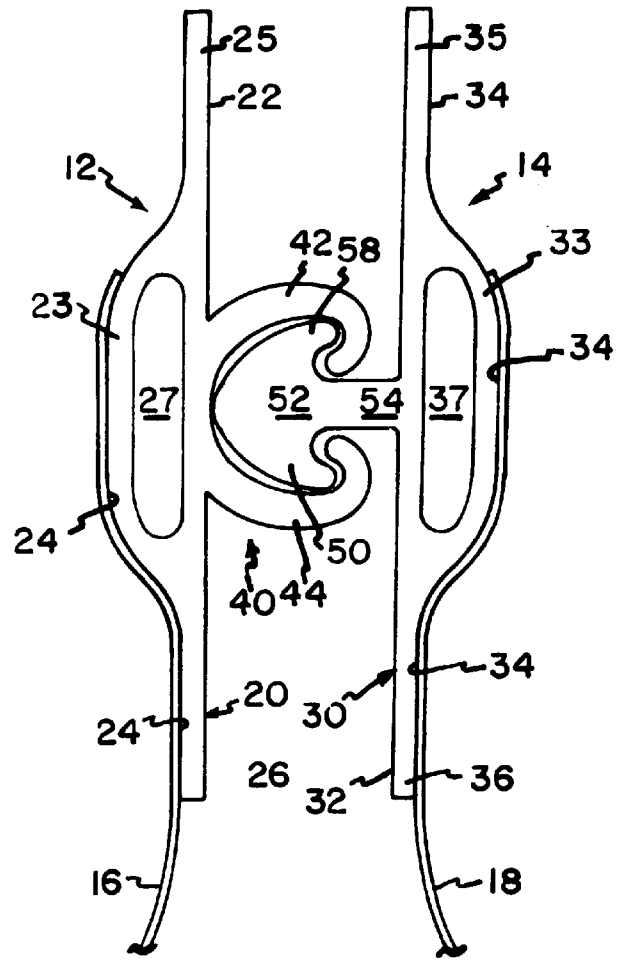
FIG. 3 is an enlarged cross-sectional view of the closure arrangement shown in FIG. 1, showing the closure arrangement in a closed configuration and secured to the walls of the recloseable package.
Figure 2:
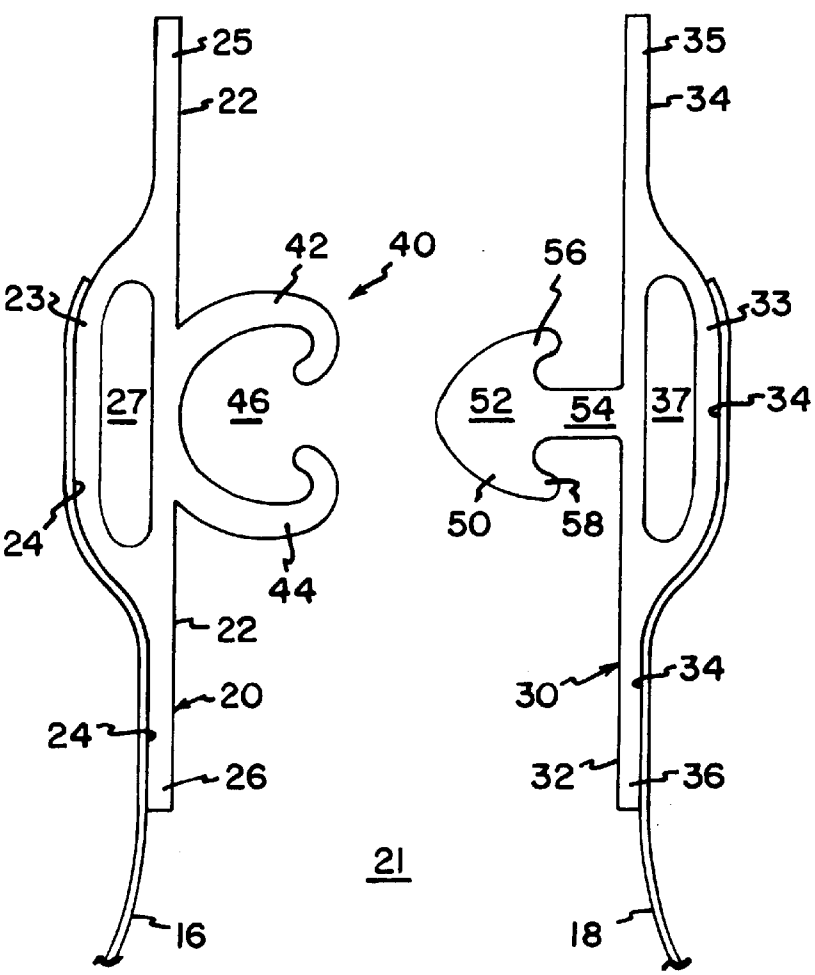
FIG. 2 is an enlarged cross-sectional view of the closure arrangement shown in FIG. 1, showing the closure arrangement in an open configuration and secured to the walls of the recloseable package.

Referring now to FIG. 2 and FIG. 3, the closure profiles 12 and 14 are shown in cross section in greater detail than is depicted in FIG. 1. The closure profiles 12 and 14 are shown in an "unlocked" or "open" position in FIG. 2, but in a "locked" or "closed" position in FIG. 3. In the open position the contents 19 (see FIG. 1) may be added or removed from the package 10. However, in the closed position, the bag 10 is sealed such that the contents 19 may not escape from the package. In certain implementations, the seal formed between the first and second closure profiles 12, 14 is substantially air tight. In most applications, the closure arrangement may be repeatedly interchanged between "open" and "closed" configurations shown in FIGS. 2 and 3, thus making the package "recloseable".

Referring specifically to FIG. 2, it is apparent that closure profile 12 includes a base strip 20, having a continuous first segment and a continuous second segment, and a female profile 40. Female profile 40 is integrally formed to base strip 20. In addition, base strip 20 includes a top flange 25 and ai bottom flange 26. An inner surface or side 22 of the second segment of the base strip 20 faces toward the interior 21 of the package. In addition, an outer side or surface 24 of the first segment faces outward from the interior 21 and opposite the female profile 40. Positioned within the base strip 20 is a compartment 27 that is intermediate the inner side 22 of the second segment and outer side 24 of the first segment. An exterior wall 23 of the base strip 20 is positioned on the side of the compartment 27 opposite the female profile 40. In the embodiment shown in FIG. 2, the compartment 27 is positioned behind the female profile 40 such that it is integrally formed into the base strip 20. The first and second segments are joined at first and second continuous portions to enclose and define compartment 27.

Closure profile 14, also shown in FIGS. 2 and 3, is shown positioned substantially opposite and in-line with closure profile 12 includes a second base strip 30, having a continuous third segment and a continuous fourth segment, and a male profile 50. The second base strip 30 is depicted having an inner side or surface 32 of the fourth segment and an outer side or surface 34 of the third segment. Intermediate inner side 32 of the fourth segment and outer side 34 of the third segment of the base strip 30 is a compartment 37. The third and fourth segments are joined at third and fourth continuous portions to enclose and define compartment 37. Compartment 37 protects the male profile 50 from deformation due to heat exposure during heat sealing of the base strip 30 to the second web 18 of the flexible package 10. The embodiment depicted shows the web 18 fused along the lower flange 36 as well as opposite the compartment 37. It will be appreciated that the web 18 can also be fused opposite the compartment 37.

In the embodiment depicted, the closure arrangement 9 of the present invention is configured to be recloseably sealed by interlocking the female and male profiles 40, 50. The female profile 40 includes at least two legs 42, 44 defining a space 46. The male profile 50 includes a head 52 and a stem 54, as depicted in FIG. 2. As shown in FIG. 2, the head member 52 of the male profile 50 includes shoulders 56, 58. To close the recloseable package 10, the male profile 50 is inserted into female profile 40 such that legs 42, 44 of the female profile 40 interlock with the shoulders 56, 58 of the male profile 50. The head 52 of the male profile 50 is retained in the space 46 between the legs 42, 44 of the female profile 40.

Base strips 20, 30 each include flanges. Top flanges 25, 35 enable a user to easily open the recloseable package 10 by applying a pulling force to the closure arrangement to disengage the female and male profiles 40, 50. Bottom flanges 26, 36 provide additional surfaces for the webs 16, 18 forming the exterior of the bag to be secured to the base strips, and also provide additional strength. However, it will be appreciated that some or all of these flange members may be eliminated from the closure arrangement 9 such that the base strips do not include flange members. In such embodiments, the compartments 27, 37 are still present in one or both of the base strips, and the webs 16, 18 are secured to the base strip by thermal sealing the walls 23, 33 opposite the compartments 27, 37.

It will be appreciated that an important aspect of the present invention is the insulating properties of the compartments 27, 37 in protecting the closure profile or profiles 40, 50 from thermal deformation during heat sealing of the web members 16, 18. In specific implementations of the present invention, the compartments 27, 37 contain air or another gaseous composition. In other implementations, the compartments 27, 37 contain foamed polyethylene or another polyolefic carrier. In the event that these compartments 27, 37 contain air, it will normally not be necessary to inject or otherwise add the air to the compartments. To the contrary, this compartment and the air within it will be formed during the creation or extrusion of the closure profiles 12, 14. While air or other gaseous material will not be injected into the compartment in some implementations, it will be appreciated that in other implementations air or other gases may be delivered into the compartments 27, 37. Such gases may be delivered under pressure, such as during the extrusion process. Even if the compartments 27, 37 do not stay pressurized, such gases may help to maintain the shape of the compartments during extrusion and cooling. Alternatively, in specific implementations, compartments 27, 37 have a specific material preferentially inserted into the compartments. This material may be, for example, a low heat-conducting gas or a solid or liquid material that has improved insulating properties. The purpose of the compartments 27, 37 is to insulate the profiles 40, 50 from the heat of thermal fusion between the base strips and the package webs. It will be appreciated that when compartments 27, 37 contain air or other gaseous components, the base strips will have lower thermal conduction properties than the polymeric compound used to form the remainder of the base strips 20, 30.

Figure 4:
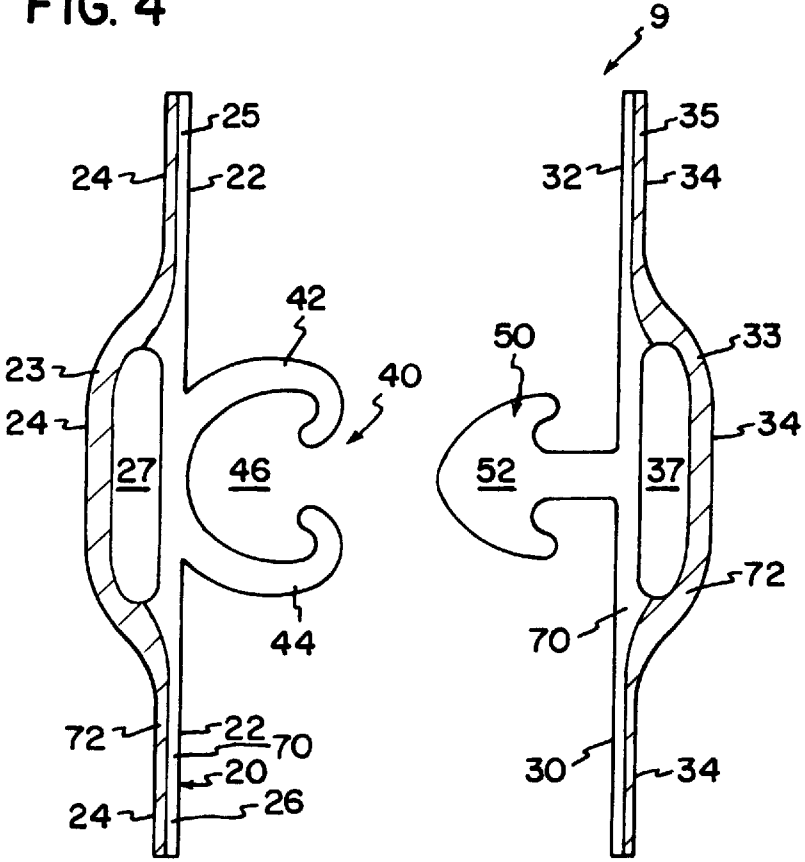
FIG. 4 is an enlarged cross-sectional view of a closure arrangement constructed in accordance with the present invention, showing the closure arrangement constructed of two separate materials.

Referring now to FIG. 4, it will be appreciated that in specific implementations of the present invention base strips 20, 30 will be composed of more than one polymeric material. For example, as shown in FIG. 4, the outer portion or attachment portion 72 of the base strips 20, 30 proximate the outer sides 24, 34 may be composed of a first material while the inner portion of the base strip, including the closure profiles, proximate the inner side 22, may be composed of a different polymeric material. Likewise, the inner portion or profile portion 70 of the base strip 30 may include a first material forming the portion of the base strip proximate the inner side 32 and the male profile 50.

Figure 5:
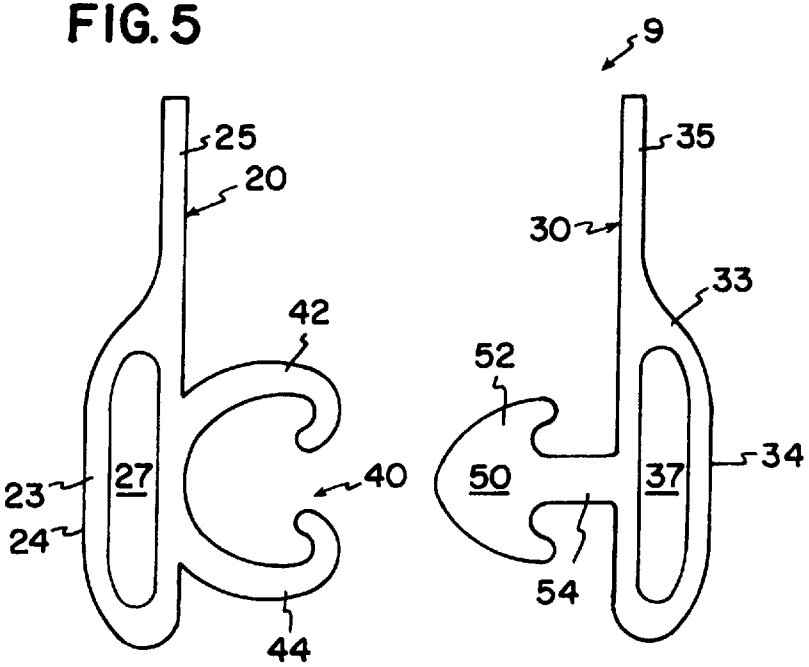
FIG. 5 is an enlarged cross-sectional view of a closure arrangement constructed in accordance with the present invention, showing the closure arrangement without a bottom flange.

Referring now to FIG. 5, it will be appreciated that the closure arrangement 9 of the present invention does not require a bottom flange. In such implementations, the web of the package is secured to the walls 23, 33 of the closure profiles opposite compartments 27, 37, but not to a bottom flange. It should be appreciated that even when a bottom flange is present (see FIG. 2, for example), the package web is not necessarily thermally fused to the flange but can be fused only to walls 23, 33.

Figure 6:
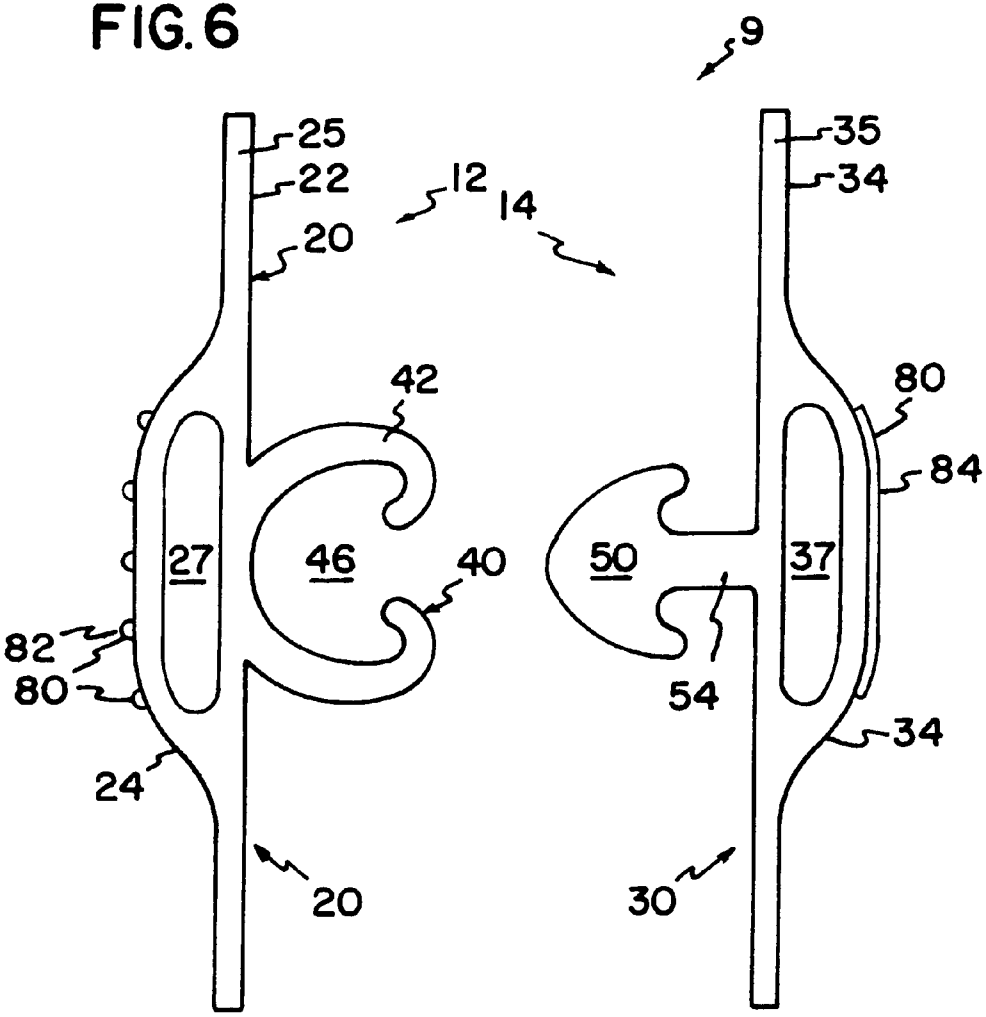
FIG. 6 is an enlarged cross-sectional view of a closure arrangement constructed in accordance with the present invention, showing an adhesive compound on the outer side of the base strip.

Referring now to FIG. 6, the outer sides 24, 34 of the closure arrangement base strips 20, 30 may further include a heat-setting adhesive 80 for enhancing the bond between the webs 16, 18 (see FIGS. 2 and 3) and the closure profiles 12, 14. Adhesive 80 may be applied in various configurations to the outer sides 24, 34 of the closure profiles 12, 14. For example, the adhesive may be applied as rows 82, strips 84, or dots. Adhesive 80 may be selected from the group consisting of anhydride modified polyolefins, metallocene catalyzed low density polyethylene, maleic anhydride, anhydride modified ethylene vinyl acetate, polypropylene copolymers, polypropylene copolymers blended with ethylene vinyl acetate, polypropylene copolymers and polyolefin blends, polypropylene terpolymers, polypropylene terpolymers and polyolefin blends, polypropylene terpolymers and ethylene vinyl acetate blends, polypropylene based thermoplastic polyolefins, butene polypropylene copolymers and polypropylene-based flexible polyolefins. The adhesive 80 may be applied by being co-extruded with the remainder of the closure arrangement or may be applied after the base strips and closure profiles have been extruded.

As noted earlier, the closure arrangement may be formed by extrusion, with the attachment portion and profile portion of the base strip formed by simultaneous co-extrusion. Also, the compartment 27, 37 within the base strips 20, 30 may be formed during the extrusion process. Alternatively, the profile portion 70 and attachment portions 72 (see FIG. 4) of the base strips 20, 30 are extruded separately and subsequently joined to each other after extrusion to form the compartments 27, 37.

The present invention is also directed to a complete package having the closure arrangement 9 adhered to webs 16, 18. Referring again to FIGS. 1, 2, and 3, in specific aspects of the invention, recloseable package 10 has first and second generally extruded base strips 20, 30, each of the base strips having an inner side and an outer side. The package 10 includes a first zipper profile positioned on the inner side of the first base strip and a second zipper profile positioned on an inner side of the second base strip. The zipper profiles are positioned and configured to interlock with one another. A compartment is contained within at least one of the first and second extruded base strips. The compartment is positioned within the extruded base strips between the inner side and the outer side. A polymeric film is secured to the outer side of each of said base strips. In specific implementations, the compartment within at least one of the first and second base strips has low heat conduction properties. As noted above, the compartment within at least one of the first and second base strips 20, 30 encloses air in certain implementations.

Another aspect of the invention is directed to a method of manufacturing a closure arrangement for a polymeric bag having first and second opposing base strips. The method includes providing an extrusion die configured and arranged for the extrusion of at least one polymeric material, and providing a thermoplastic material for extruding through the extrusion die. The thermoplastic material is extruded through the extrusion die to form a base strip, the base strip having an inner side, an outer side, a zipper profile integrally formed to the inner side, and a compartment defined by a space between the inner side and outer side of the base strip.

The step of extruding a thermoplastic material may include extruding a first material to form a portion of the base strip proximate the inner side 22 of the female profile, and extruding a second material to form an outer portion of the base strip proximate the outer side 24 of the base strip. The method may further include providing a polymeric film having an interior surface and an exterior surface, and providing a closure arrangement having first and second base strips, each of said base strips having an inner side, an outer side, a zipper profile integrally formed to the inner side, and a compartment defined by a space between the inner side and outer side of the base strip. The closure arrangement is positioned so that a portion of the outer side of each base strip proximate the compartment is near the polymeric film; and the polymeric film is thermally-fused or heat-set to the base strips by application of heat to the polymeric film and the closure arrangement. The outer side of each of the base strips is permanently adhered to the interior surface of the polymeric film at a position opposite the compartment.

While the present invention has been described with reference to several particular implementations, those skilled in the art will recognize that many changes may be made hereto without departing from the spirit and scope of the present invention. It is intended that the specification and examples be considered as exemplary only, with the true scope and spirit of the invention being indicated by the following claims.

I claim:

1. A closure arrangement for use with a recloseable package; the closure arrangement comprising:

(a) a base strip having a first side and an opposite second side; said base strip including:
  (i) a continuous first segment defining said fist side;
  (ii) a continuous second segment defining said second side;
    (A) said first segment and said second segment being integrally joined at first and second continuous portions;
    (B) said first segment and said second segment being spaced apart from one another along an extension between said first and second continuous portions to define a space therebetween;

(b) material within said space;
  (i) said material conducting heat at a rate lower than a material of said base strip; and (c) a zipper profile integral with and projecting from said second side of said base strip; wherein said space is positioned directly behind said zipper profile.

2. A closure arrangement according to claim 1 wherein:

(a) said material within said space comprises a gas.

3. A closure arrangement according to claim 1 wherein:

(a) said material within said space comprises air.

4. A closure arrangement according to claim 1 wherein:

(a) said zipper profile comprises at least two legs.

5. A closure arrangement according to claim 4 wherein:

(a) said space is oriented behind said two legs of said zipper profile.

6. A closure arrangement according to claim 1 wherein:

(a) said zipper profile comprises a head and stem.

7. A closure arrangement according to claim 6 wherein:

(a) said space is oriented behind said stem of said zipper profile.

8. A closure arrangement according to claim 1 wherein:

(a) said base strip includes an attachment portion on said first side of said base strip.

9. A closure arrangement according to claim 8 wherein:

(a) said attachment portion is constructed of a first polymeric material, and said zipper profile is constructed of a second polymeric material different from said first polymeric material.

10. A closure arrangement according to claim 8 further including:

(a) a layer of adhesive secured to said attachment portion of said base strip.

11. A package comprising:

(a) a first web of film;

(b) a second web of film opposed to said first web of film;

(c) a first base strip having a first side and an opposite second side; said first base strip including:

(i) a continuous first segment defining said first side;

(A) said first side being secured to said first web of film;

(ii) a continuous second segment defining said second side;

(A) said first segment and said second segment being integrally joined at first and second continuous portions;

(B) said first segment and said second segment being spaced apart from one another along an extension between said first and second continuous portions to define a first space therebetween;

(d) a first material with said first space;

(i) said first material conducting heat at a rate lower than a material of said first base strip;

(e) a first zipper profile integral with and projecting from said second side of said first base strip; said first space positioned directly behind said first zipper profile;

(f) a second base strip having a third side and an opposite fourth side;

(i) said third side being secured to said second web of film;

(g) a second zipper profile integral with and projecting from said fourth side of said second base strip;

(i) said second zipper profile constructed and arranged to engage said first zipper profile.

12. A package according to claim 11 wherein:

(a) said second base strip includes:

(i) a continuous third segment defining said third side;

(ii) a continuous fourth segment defining said fourth side;

(A) said third segment and said fourth segment being integrally joined at third and fourth continuous portions;

(B) said third segment and said fourth segment being spaced apart from one another along an extension between said third and fourth continuous portions to define a second space therebetween; said second space positioned behind said second zipper profile.

13. A package according to claim 12 further including:

(a) a first layer of adhesive between said first web of film and said first side of said first base strip; and (b) a second layer of adhesive between said second web of film and said third side of said second base strip.

14. A package according to claim 12 further including:

(a) a second material within said second space;

(i) said second material conducting heat at a rate lower than a material of said second base strip.

15. A package according to claim 14 wherein:

(a) said second material within said second space comprises a gas.

16. A package according to claim 11 wherein:

(a) said first material within said first space comprises a gas.

* * * * *